United States Patent [19]

Kobayashi

[11] 4,211,203

[45] Jul. 8, 1980

[54] FUEL INJECTION PUMP

[75] Inventor: Masayoshi Kobayashi, Higashi-Matsuyama, Japan

[73] Assignee: Diesel Kiki Co., Ltd., Tokyo, Japan

[21] Appl. No.: 971,914

[22] Filed: Dec. 21, 1978

[30] Foreign Application Priority Data

Dec. 29, 1977 [JP] Japan ..... 52-176249

[51] Int. Cl.[3] ..... F02M 39/00; F02M 41/08

[52] U.S. Cl. ..... 123/406; 123/496; 123/505; 123/511

[58] Field of Search ..... 123/139 AF, 139 AW, 123/139 AY, 140 FG, 139.13 G; 417/283

[56] References Cited

U.S. PATENT DOCUMENTS

| | | | |
|---|---|---|---|
| 2,794,397 | 6/1957 | Borman | 123/139 AF |
| 3,231,003 | 1/1966 | Richcreek | 123/139 AF |
| 3,339,534 | 9/1967 | Eheim | 123/140 FG |
| 3,614,270 | 10/1971 | Franke | 123/140 FG |
| 3,631,743 | 1/1972 | Eckert | 123/139 AF |
| 3,699,939 | 10/1972 | Eckert | 123/140 FG |
| 3,827,832 | 8/1974 | Faupel | 123/139 AY |
| 4,073,275 | 2/1978 | Hofer | 123/139 AF |

*Primary Examiner*—Charles J. Myhre
*Assistant Examiner*—Carl Stuart Miller
*Attorney, Agent, or Firm*—Frishauf, Holtz, Goodman & Woodward

[57] ABSTRACT

A distributor type fuel injection pump which includes a relief passage having one end thereof opening in the pump working chamber and the other end communicating with a zone under a lower pressure. Said relief passage is so arranged as to be permanently kept closed by a valve means which is actuated by a valve actuating means for actuating said valve means in response to a fuel supply pressure varying as a function of the engine rotational speed, except in a predetermined low engine speed range, to obtain a decreased injection rate during idling so as to increase the injection period. Thus, the rate of combustion of the engine is reduced to minimize the combustion noise.

2 Claims, 2 Drawing Figures

FUEL INJECTION PUMP

BACKGROUND OF THE INVENTION

The present invention relates to a distributor type fuel injection pump for internal combustion engines, and more particularly to a device for reducing the combustion noise occurring during the idling operation of the engine (including a state approximate to the idling).

In fuel-injection type internal combustion engines including the Diesel engine, as well known it is necessary to control the fuel injection quantity in dependence on the operating conditions of the engine such as load or engine r.p.m. For this purpose, in a conventional fuel injection pump of said type only the injection quantity is controlled so that it increases or decreases in response to the engine operating conditions while the injection rate, i.e., the injection quantity dQ per unit time dT is kept constant. According to such controlling method, in order to obtain a decreased injection quantity during idling of the engine, it is so controlled that the effective stroke of the plunger of the pump is decreased so as to reduce the injection period, which results in an ignition lag in the cylinders of the engine, thus leading to sudden explosive combustion lasting for a short time and consequent knocking of the engine, with a resulting increased combustion noise peculiar to the idling of the engine. This noise phenomenon constitutes a public annoyance.

OBJECT AND SUMMARY OF THE INVENTION

Accordingly, it is an object of the invention to provide a distributor type fuel injection pump which can have a decreased injection rate during idling so as to increase the injection period, thereby reducing the rate of combustion of the engine to achieve a large reduction in the combustion noise.

According to the invention, there is provided an improved distributor type fuel injection pump which includes: a relief passage having one end thereof opening in the pump working chamber and the other end communicating with a zone under a lower pressure; a valve means arranged for blocking the relief passage; and an actuating means for actuating said valve means in response to a fuel supply pressure varying as a function of the engine speed; wherein said actuating means is arranged to actuate said valve means to permanently keep said relief passage closed except in a predetermined low engine speed range.

DETAILED DESCRIPTION OF THE INVENTION

Figure 1:
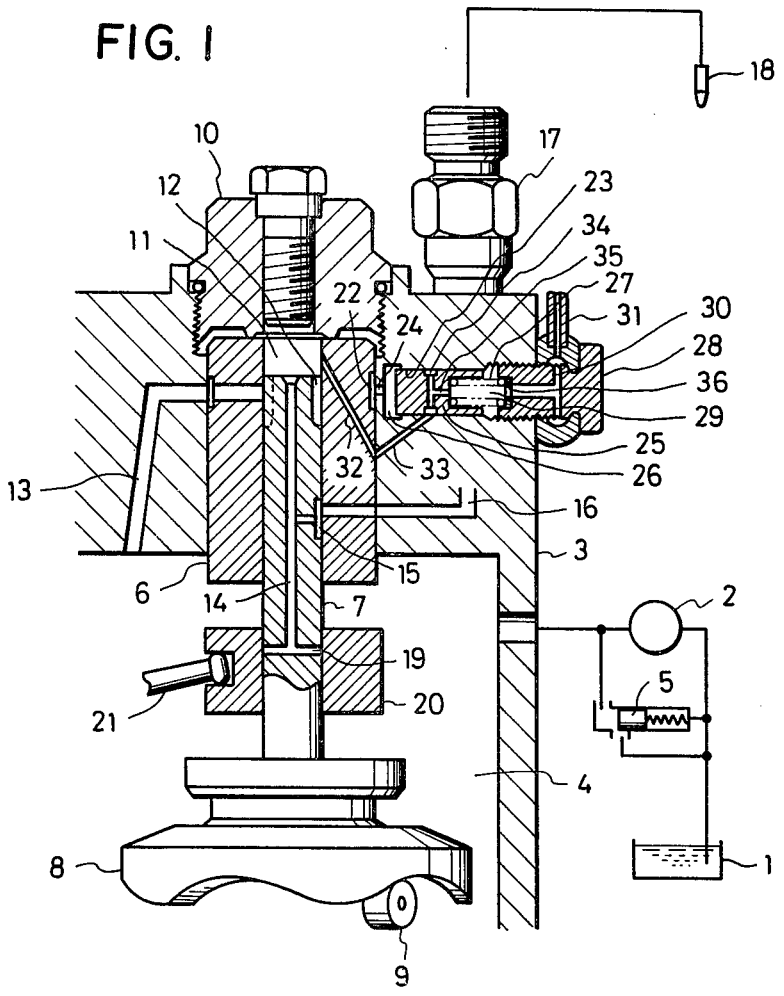
FIG. 1 is a vertical sectional view showing one embodiment of a distributor type fuel injection pump according to the invention.

Referring now to FIG. 1 an embodiment of the invention will be described. In the arrangement of FIG. 1, fuel is sucked up from a fuel reservoir 1 by a fuel pump 2 which is driven by the output shaft of an engine, not shown, and fed under pressure into a suction chamber 4 formed within the housing 3 of the fuel injection pump. In a known manner, a fuel pressure control valve 5 controls the pressure within the suction chamber 4 in dependence on engine (r.p.m) so that as the engine r.p.m. increases, so does the fuel pressure in the suction chamber 4 in a predetermined manner.

A plunger 7 is slidably received within a plunger barrel 6 penetrating the pump housing 3, for simultaneous reciprocating and rotating motion to perform the dual function of fuel pumping and distribution, as hereinafter described. More specifically, a cam plate 8 is provided integral with the plunger 7 for rotation through a driving disk, not shown, by means of the drive shaft, not shown, of the fuel injection pump driven by the engine. Said cam plate 8 has a cam surface formed at equi-intervals with highs corresponding in number to the number of the cylinders of the engine. Said cam plate 8 has its cam surface urged against rollers 9 retained on a roller holder, not shown, by a spring, not shown, so that the cam plate 8 and accordingly the plunger 7 is caused by rotation of said drive shaft to simultaneously rotate and reciprocate.

A closing plug member 10 is threadedly fitted in the housing 3 to cooperate with the plunger barrel 6 and the top end of the plunger 7 to define a pump working chamber 11. During the suction stroke when the plunger 7 is moved downwardly in the drawing, said pump working chamber 11 has an increasing volume. At the same time, one longitudinal groove 12 of a plurality of such grooves formed in the peripheral surface of the top end of the plunger 7 faces one end of a supply line 13 formed in the housing 3 with the other end of the supply line 13 opening in the suction chamber 4 so that fuel is sucked into the pump working chamber 11.

When the plunger 7 is upwardly moved through the delivery stroke, the communication between the supply line 13 and the longitudinal grooves 12 is interrupted and accordingly the fuel introduced into the working chamber 11 is delivered under pressure through a channel 14 axially extending through the central portion of the plunger 7 and longitudinal distributing groove 15 formed in the outer periphery of the plunger 7 into outlet pressure lines 16 penetrating the barrel 6 and the pump housing 3, and then fed through delivery valves 17 into injection nozzles 18 to be injected into the respective cylinders of the engine. Only one each of the outlet pressure lines 16, delivery valves 17, and injection nozzles 18 is shown for the simplification of illustration. Said outlet pressure lines 16 are the same in number as the number of cylinders in the engine and are arranged circumferentially of the barrel 6 and the housing 3 at equal-intervals so that fuel is injected into each of the cylinders alternately in a predetermined order in accordance with the reciprocating and rotating motion of the plunger 7.

Also formed in a portion of the plunger 7 projecting into the suction chamber 4 is a transverse cut-off port 19 intersecting the channel 14 for communication of said channel 14 with the suction chamber 4. The cut-off port 19 is adapted to be obturated by the inner peripheral surface of a fuel quantity setting sleeve 20 which is slidably fitted on said portion of the plunger 7. Thus, when the plunger 7 is upwardly moved to disengage the cut-off port 19 from the upper edge of the sleeve 20 to cause the port 19 to open into the suction chamber 4, fuel in the channel 14 flows through the cut-off port 19 into the suction chamber 4, and accordingly the delivery of fuel into the outlet pressure lines 16 is interrupted thus to terminate the injection of delivery stroke of the plunger. The fuel quantity setting sleeve 20 is arranged in engagement with a lever 21 arranged for pivotal motion by means of an operating input mechanism for presetting a desired engine speed and a governor mechanism for detecting an actual engine speed (neither of them is shown) so that when the engine speed is to be set to a lower value or when the engine is being operated at a higher speed than a preset speed, said sleeve 20 is displaced downward in the drawing to obtain a sooner injection end during the delivery stroke, thus reducing the injection quantity.

Formed around the outer periphery of the barrel 6 is an annular groove intersecting said supply line 13 to define an annular chamber 22, while the pump housing 3 is formed with a bore 23 which has an outward end thereof terminating in an outer periphery thereof and the other inward end communicating with the annular chamber 22 through a communication port 24 with a small diameter formed at the bottom or inward end of said bore 23. Said supply line 13, annular chamber 22 and communication port 24 constitute an actuating means for a valve hereinbelow described.

A piston 25 is slidably received within said bore 23 as a main component element of said valve means, whose top or front end cooperates with the bore 23 to define a chamber 26. Fitted in the outward end of said bore 23 is a closing plug 28, with a compression spring 27 interposed between the rear end of said piston 25 and said closing plug 28. Said plug 28 has an internal passage 30 having one end opening in a chamber 29 defined by said rear end of the piston 25 and the plug 28, and the other end connected through a spill tube 31 to a zone under a lower pressure such as the suction port of the aforementioned fuel pump 2.

A communication port 32 is formed through the plunger barrel 6 with one end thereof opening in said pump working chamber 11 and the other end terminating in an outer periphery of the same barrel 6, while the pump housing 3 is also formed with another communication passage 33 whose one end terminates in an inner periphery of the housing 3 in register with said communication port 32, the other end terminating in an inner periphery of said bore 23.

Said piston 25 also has an outer periphery thereof formed with an annular groove 34 which is so located as to register with said open end of the communication passage 33 at a predetermined position of the piston 25 within the bore 23. The piston 25 also has the interior thereof formed with a restriction passage 35 having one end thereof radially opening in said annular groove 34 and the other end opening in said chamber 29 which is under a lower pressure.

With this arrangement, since the supplied fuel pressure produced by the rotation of said fuel pump 2 is nearly zero when the engine has just started and accordingly there is substantially no fuel pressure prevailing in the chambers 22, 26, the piston 25 is urged by the spring 27 to be biased more leftward in the drawing than its illustrated position to keep the open end of the communication passage 33 from aligning with said annular groove 34 of the piston 25. Consequently, fuel injection takes place under a normal or usual injection pressure.

When the engine is operated in a low speed condition mainly including the idling speed, the fuel being delivered through the pump has a somewhat increased pressure to accordingly increase the fuel pressure in the chambers 22, 26 which causes the piston 25 to be rightwardly displaced from said position in engine starting to the illustrated position to allow the open end of the communication passage 33 to register with the annular groove 34 of the piston 25. Accordingly, when the plunger 7 upwardly moves into its fuel pressure feeding position part of the fuel in the pump working chamber 11 flows through the communication port 32 and the passage 33, the annular groove 34 of the piston 25 and the restriction passage 35 into the low-pressure chamber 29, thus enabling to keep the increase in the fuel pressure in the pump working chamber 11 within a certain range.

Meanwhile, in middle and high engine speed ranges, the pressure of fuel being delivered is increased and accordingly the piston 25 is displaced rightward of the illustrated position to again cut off the communication between the open end of the communication passage 33 and the annular groove 34 of the piston 25, so that the fuel pressure in the pump working chamber 11 can be elevated up to a normal or usual pressure.

Incidentally, the engine speeds at which the open end of the communication passage 33 and the annular groove 34 of the piston 25 can meet each other may be adjusted merely by inserting one or more shims 36 between the plug 28 and the spring 27 which have been adjusted in thickness or in number. Alternatively, the plug 28 may be so arranged as to be adjustably displaced axially of the bore 23 by turning it.

The above-described arrangement thus can achieve a lower injection pressure than a normal or usual value in the low engine speed range mainly including the idling speed, while permitting fuel injecting operation under a normal or usual injection pressure in other engine speed ranges such as engine starting or middle and high engine speed ranges.

Figure 2:
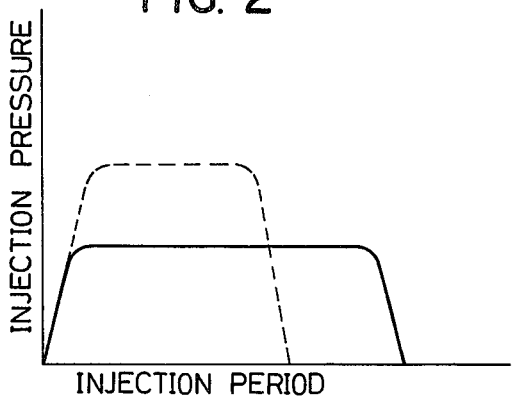
FIG. 2 is a graph showing the injection rate characteristics obtained by the distributor type fuel injection pump according to the invention, in comparison with those obtained by the conventional distributor type fuel injection pump.

Thus, by previously selecting a longer injection period for the idling operation, an injection rate characteristic as shown in solid line in FIG. 2 can be obtained in idling (a conventional characteristic is represented in broken line), thus enabling a reduction in the combustion rate to minimize the combustion noise.

As described in the foregoing, the arrangement according to the invention has a simple construction which is capable of minimizing the combustion noise through reduction in the injection pressure during the idling operation.

It is to be understood that the foregoing description relates to a preferred embodiment of the invention and that various changes and modifications may be made in the invention without departing from the spirit and scope thereof.

What is claimed is:

1. In a fuel injection pump for an internal combustion engine, including: a housing, a barrel mounted within said housing; a plunger mounted within said barrel for axial and rotary motion therein; a pump working chamber defined by the housing, the barrel and the plunger; a suction chamber formed within said housing; and outlet pressure lines for connecting said pump working chamber with associated fuel injection nozzles;

the improvement which comprises:

a relief passage having one end thereof opening in said pump working chamber and the other end communicating with a zone under a lower pressure, said relief passage extending from said barrel through said housing;

a valve means arranged for blocking said relief passage; and an actuating means for actuating said valve means in response to a fuel supply pressure varying as a function of engine rotational speed, said actuating means being arranged to actuate said valve means to permanently keep said relief passage closed except in a predetermined low engine speed range;

said valve means comprising a bore formed within said pump housing and communicating on one side with said relief passage and on the other side with a zone under a lower pressure; a piston slidably received with said bore, said piston including an annular groove formed in an outer periphery thereof, and a restriction passage having one end thereof radially opening in said annular groove and the other end communicating with said lower pressure zone; and said actuating means comprising a passage means having one end thereof communicating with one end of said bore and the other end thereof with a fuel pump arranged for rotation at a speed which is a function of the rotational speed of the engine; said pressure means comprising a fuel supply line having two ends, one end of said fuel supply line communicating with said suction chamber formed within said pump housing, which is supplied with a fuel pressure which is a function of the engine speed from said fuel pump, and the other end of said fuel supply line being arranged for communication with said pump working chamber; a further annular groove formed around an outer periphery of said barrel and intersecting with said fuel supply line; and a communicating port formed within said housing and providing communication between said further annular groove and said bore.

2. The fuel injection pump of claim 1 wherein said suction chamber is supplied with a fuel pressure from said fuel pump, said fuel pressure being proportional to the engine speed.

* * * * *

UNITED STATES PATENT AND TRADEMARK OFFICE

CERTIFICATE OF CORRECTION

PATENT NO. : 4,211,203

DATED : July 8, 1980

INVENTOR(S) : Masayoshi KOBAYASHI

It is certified that error appears in the above-identified patent and that said Letters Patent are hereby corrected as shown below:

COLUMN 2, line 2, change "engine (r.p.m.)" to --engine speed (r.p.m.)--;

COLUMN 6, line 2, change "pressure means" to --passage means--.

Signed and Sealed this

*Eighteenth* Day of *November 1980*

[SEAL]

*Attest:*

SIDNEY A. DIAMOND

*Attesting Officer*

*Commissioner of Patents and Trademarks*